US010864452B2

(12) United States Patent
Fernandez

(10) Patent No.: US 10,864,452 B2
(45) Date of Patent: Dec. 15, 2020

(54) TOY WITH TWO BODIES AND AN EJECTABLE GEAR AND RETRACTION MECHANISM

(71) Applicant: Darwin William Fernandez, Granada (MX)

(72) Inventor: Darwin William Fernandez, Granada (MX)

( * ) Notice: Subject to any disclaimer, the term of this patent is extended or adjusted under 35 U.S.C. 154(b) by 0 days.

(21) Appl. No.: 15/877,175

(22) Filed: Jan. 22, 2018

(65) Prior Publication Data

US 2019/0224582 A1 Jul. 25, 2019

(51) Int. Cl.

| | |
|---|---|
| ***A63H 7/00*** | (2006.01) |
| ***A63H 33/00*** | (2006.01) |
| ***A63H 11/00*** | (2006.01) |
| ***A63H 29/00*** | (2006.01) |
| ***A63H 13/00*** | (2006.01) |

(52) U.S. Cl.

CPC ..... *A63H 33/003* (2013.01); *A63H 11/00* (2013.01); *A63H 13/00* (2013.01); *A63H 29/00* (2013.01)

(58) Field of Classification Search

CPC ..... A63H 33/003; A63H 11/00; A63H 11/14; A63H 29/00; A63H 29/18; A63H 13/16; A63B 43/02

USPC ..... 446/72, 233, 234, 239, 260, 264, 266, 446/269, 289, 308, 309, 310, 320

See application file for complete search history.

(56) References Cited

U.S. PATENT DOCUMENTS 1,207,200 A 12/1916 Novak
1,585,887 A * 5/1926 Beach ..... A63H 13/16 446/310
1,657,175 A 5/1926 Peace
2,968,121 A 4/1958 Pearson, Jr. et al.
3,798,835 A 3/1974 McKeehan
4,205,482 A * 6/1980 Christiansen ..... A63H 3/16 446/118

(Continued)

FOREIGN PATENT DOCUMENTS

CN 206793044 U 12/2017
EP 2116289 A1 11/2009

OTHER PUBLICATIONS

International Search Report and Written Opinion (PCT/US2018/053900) [SR/KR] dated Feb. 1, 2019.

(Continued)

*Primary Examiner* — Joseph B Baldori

(74) *Attorney, Agent, or Firm* — Edwin S. Flores; Daniel J. Chalker; Chalker Flores, LLP

(57) ABSTRACT

The present invention includes A toy with an extendable mechanism capable of transforming its original compact shape into a new entity without need to manipulate its parts or add new parts comprising: a hollow sphere (1) formed from two caps; an upper hinge (4) at a top of the hollow sphere (1) that connects two symmetrical caps; two protuberances (5) generally centrally located in each of the caps connected to a central internal spring; a circular hinge (6) connected to a spring and the hinges articulate two cylindrical arms (7) that converge in two circular hinges (8) contained within a central casing (9); and a body-shaped part (10) connected to the central casing (9), such that the body-shaped part (10) projects out from the lower part of the sphere (1), and upon being ejected, the caps close automatically with a spring at the upper hinge (4).

8 Claims, 5 Drawing Sheets

(56) References Cited

U.S. PATENT DOCUMENTS 4,519,786 A * 5/1985 Larws ..... A63H 33/04 446/376
4,687,459 A * 8/1987 Lockett ..... A63H 33/00 446/268
4,698,043 A * 10/1987 May ..... A63H 33/005 446/273
4,736,943 A * 4/1988 Fukuda ..... A63H 13/02 446/310
4,817,936 A * 4/1989 Matsuda ..... A63H 13/02 446/310
5,098,327 A * 3/1992 Ferrero ..... A63F 9/001 446/487
5,162,013 A * 11/1992 von Mohr ..... A63H 3/12 446/183
5,297,981 A 3/1994 Maxim et al.
5,409,414 A 4/1995 Sheang
5,525,090 A * 6/1996 Halford ..... A63H 17/00 446/330
5,871,386 A * 2/1999 Bart ..... A63H 15/06 446/443
5,893,789 A 4/1999 Wu
5,924,909 A 7/1999 Yamakawa
5,924,910 A * 7/1999 Liu ..... A63H 17/26 446/435
6,231,346 B1 5/2001 Sagi-Dolev
6,468,126 B1 * 10/2002 Herber ..... A63H 13/16 446/308
6,536,145 B2 * 3/2003 Burtch ..... G09F 1/06 40/124.08
6,761,612 B1 * 7/2004 Pencil ..... A63H 13/16 40/411
7,166,047 B2 1/2007 May et al.
7,306,504 B2 * 12/2007 Saucier ..... A63H 3/003 446/268
7,458,874 B2 * 12/2008 Rung ..... A63H 13/00 446/330
7,553,209 B1 * 6/2009 Sorensen ..... A63H 33/06 446/124
8,066,542 B2 11/2011 Ejima
8,500,508 B2 8/2013 Yamada et al.
8,517,791 B2 * 8/2013 Yamada ..... A63H 33/26 446/129
8,974,264 B2 * 3/2015 McCafferty ..... A63H 17/008 124/10
9,308,461 B2 4/2016 Yamada et al.
9,694,295 B2 7/2017 Walterscheid
9,975,058 B2 5/2018 Yamada et al.
2014/0094082 A1 4/2014 Swartz et al.
2015/0238880 A1 8/2015 Austin
2016/0214025 A1 7/2016 Yamada et al.
2016/0361661 A1 * 12/2016 Tiefel ..... A63H 33/003

OTHER PUBLICATIONS

International Search Report and Written Opinion (PCT/US2018/053906) [SR/KR] dated Feb. 1, 2019.

* cited by examiner

TOY WITH TWO BODIES AND AN EJECTABLE GEAR AND RETRACTION MECHANISM

CROSS-REFERENCE TO RELATED APPLICATIONS

None.

STATEMENT OF FEDERALLY FUNDED RESEARCH

None.

TECHNICAL FIELD OF THE INVENTION

The present invention relates in general to the field of toys.

BACKGROUND OF THE INVENTION

Without limiting the scope of the invention, its background is described in connection with model toys.

One such toy is taught in U.S. Pat. Nos. 9,308,461 and 8,500,508, issued to Yamada, et al., entitled "Transformable toy", teach a toy with an exterior structure that is constructed to transform from a rollable first shape to a second shape. An interior structure inside the exterior structure is endowed with a magnetic body that moves by way of a magnetic force that acts from the exterior of the toy, an interior locking portion that moves simultaneously with the movement of this magnetic body, and a biasing member that effects a force which moves or turns this interior locking portion in a particular direction. According to this invention, if the magnetic force does not act from the exterior of the toy, the first shape of the exterior structure maintained. In the event that a magnetic force has acted from the exterior of the said toy, the exterior structure transforms from the first shape to the second shape.

Another such toy is taught in U.S. Pat. No. 7,166,047, issued to May, et al., entitled, "Toy ball", which teaches a toy ball that is formed from two shells and a pair of lock mechanisms. During construction, the shells, which may be hemispherical, are mated together and then the lock mechanisms are secured to the shells to form a substantially smooth-surfaced sphere, wherein the lock mechanisms provide a redundant locking feature to hold the two shells together to form the toy ball.

Finally, U.S. Pat. No. 5,409,414, issued to Sheang, and entitled "Toy sphere" teaches a toy sphere that includes an annular member provided with a circular groove at both sides, a plurality of internal gear teeth at an inner surface, and two opposite eccentric pins at an outer surface, a power seat threadedly engaged with the internal gear teeth of the annular member and having a motor electrically connected with batteries, an upper hemispherical housing having internal threads, a lower hemispherical housing having external threads engageable with the internal threads of the upper hemispherical and having two aligned holes engaged with the two opposite eccentric pins of the annular member.

SUMMARY OF THE INVENTION

The present invention is a sphere-shaped toy; with a retractable mechanism, that upon pressing the upper button ejects a cylindrical figure capable of transforming its original compact shape into a new entity, without the need to manipulate or add new parts to which corresponds a toy with characteristics described hereafter pursuant to the drawings that form an integral part of this submission.

In one embodiment, the present invention includes a toy with an extendable mechanism capable of transforming its original compact shape into a new entity without need to manipulate its parts or add new parts comprising: a hollow sphere (1) formed from two caps, provided with a circular opening on the lower part thereof (2) and a vertical cut (3) on the lateral diameter, which divides it in two symmetrical caps; an upper hinge (4) at a top of the hollow sphere (1) that connects two symmetrical caps; two protuberances (5) generally centrally located in each of the caps connected to a central internal spring; a circular hinge (6) located internally from the two protuberances (5), wherein one or both hinges are connected to a spring and the hinges articulate two cylindrical arms (7) with oblique ascendant inclination, wherein each upper part of the cylindrical arms (7) converge in two circular hinges (8) that are each provided with a radial sequence of curved concave notches, in turn, these hinges (8) are contained within a central casing (9); and a body-shaped part (10) connected to the central casing (9), wherein the body-shaped part (1) is provided with one or more features selected from: a neck, a central torso, one or more lateral arms with their respective hands, or one or more lower legs with their respective feet, in such a way, that when the sphere (1) receives a strike, the spring of the frontal hinge (6) activates the movement of the central casing (9), moving it downwards, and the cylindrical arms (7) upon reaching medium height, push the caps of the sphere (1) outwards to create an such an opening in the sphere (1), such that the body-shaped part (10) projects out from the lower part of the sphere (1), and upon being ejected, the caps close automatically with a spring at the upper hinge (4). In one aspect, the body (10) is out of the sphere (1), it is constituted in the head of the body. In another aspect, the body (10) is constituted by one single part, which provides it with a higher rigidity and resistance. In another aspect, the hands of the body (10) show a slot (11), that allows the inclusion of other elements. In another aspect, the feet of the body (10) show a flat base that provide it with a higher stability and a central hexagonal sunken area (12), which allows it to be stacked to other elements. In another aspect, the shape of the body (10) can display several aspects depending on the targeted segment, ranging from the body type, whether it is animal or human, the latter with male, female or asexual gender, or with the appearance of a baby, a child or an adult. In another aspect, the sphere (1) can allow for different variations depending on the targeted segment, ranging from an oval shape, different colors or textures, or different faces, depending on the adhesive adjoined to the frontal surface.

In another embodiment, the present invention includes a method of making a toy with an extendable mechanism capable of transforming its original compact shape into a new entity without need to manipulate its parts or add new parts comprising: providing a hollow sphere (1) formed from two caps, provided with a circular opening on the lower part thereof (2) and a vertical cut (3) on the lateral diameter, which divides it in two symmetrical caps; connecting the two symmetrical caps with an upper hinge (4) at a top of the hollow sphere (1); forming two protuberances (5) generally centrally located in each of the caps connected to a central internal spring; connecting a circular hinge (6) to the two protuberances (5), wherein one or both hinges are connected to a spring and the hinges articulate two cylindrical arms (7) with oblique ascendant inclination, wherein each upper part of the cylindrical arms (7) converge in two circular hinges (8) that are each provided with a radial sequence of curved concave notches, in turn, these hinges (8) are contained within a central casing (9); and connecting a body-shaped part (10) to the central casing (9), wherein the body-shaped part (1) is provided with one or more features selected from: a neck, a central torso, one or more lateral arms with their respective hands, or one or more lower legs with their respective feet, in such a way, that when the sphere (1) receives a strike, the spring of the frontal hinge (6) activates the movement of the central casing (9), moving it downwards, and the cylindrical arms (7) upon reaching medium height, push the caps of the sphere (1) outwards to create an such an opening in the sphere (1), such that the body-shaped part (10) projects out from the lower part of the sphere (1), and upon being ejected, the caps close automatically with a spring at the upper hinge (4). In one aspect, the body (10) is out of the sphere (1), it is constituted in the head of the body. In another aspect, the body (10) is constituted by one single part, which provides it with a higher rigidity and resistance. In another aspect, the hands of the body (10) show a slot (11), that allows the inclusion of other elements. In another aspect, the feet of the body (10) show a flat base that provide it with a higher stability and a central hexagonal sunken area (12), which allow it to be stacked to other elements. In another aspect, the shape of the body (10) can display several aspects depending on the targeted segment, ranging from the body type, whether it is animal or human, the latter with male, female or asexual gender, or with the appearance of a baby, a child or an adult.

In another embodiment, the present invention includes a toy with an extendable mechanism capable of transforming its original compact shape into a new entity without need to manipulate its parts or add new parts consisting essentially of: a hollow sphere (1) formed from two caps, provided with a circular opening on the lower part thereof (2) and a vertical cut (3) on the lateral diameter, which divides it in two symmetrical caps; an upper hinge (4) at a top of the hollow sphere (1) that connects two symmetrical caps; two protuberances (5) generally centrally located in each of the caps connected to a central internal spring; a circular hinge (6) located internally from the two protuberances (5), wherein one or both hinges are connected to a spring and the hinges articulate two cylindrical arms (7) with oblique ascendant inclination, wherein each upper part of the cylindrical arms (7) converge in two circular hinges (8) that are each provided with a radial sequence of curved concave notches, in turn, these hinges (8) are contained within a central casing (9); and a body-shaped part (10) connected to the central casing (9), wherein the body-shaped part (1) is provided with one or more features selected from: a neck, a central torso, one or more lateral arms with their respective hands, or one or more lower legs with their respective feet, in such a way, that when the sphere (1) receives a strike, the spring of the frontal hinge (6) activates the movement of the central casing (9), moving it downwards, and the cylindrical arms (7) upon reaching medium height, push the caps of the sphere (1) outwards to create an such an opening in the sphere (1), such that the body-shaped part (10) projects out from the lower part of the sphere (1), and upon being ejected, the caps close automatically with a spring at the upper hinge (4).

In another embodiment, the present invention includes a toy with an extendable mechanism capable of transforming its original compact shape into a new entity without need to manipulate its parts or add new parts consisting of: a hollow sphere (1) formed from two caps, provided with a circular opening on the lower part thereof (2) and a vertical cut (3) on the lateral diameter, which divides it in two symmetrical caps; an upper hinge (4) at a top of the hollow sphere (1) that connects two symmetrical caps; two protuberances (5) generally centrally located in each of the caps connected to a central internal spring; a circular hinge (6) located internally from the two protuberances (5), wherein one or both hinges are connected to a spring and the hinges articulate two cylindrical arms (7) with oblique ascendant inclination, wherein each upper part of the cylindrical arms (7) converge in two circular hinges (8) that are each provided with a radial sequence of curved concave notches, in turn, these hinges (8) are contained within a central casing (9); and a body-shaped part (10) connected to the central casing (9), wherein the body-shaped part (1) is provided with one or more features selected from: a neck, a central torso, one or more lateral arms with their respective hands, or one or more lower legs with their respective feet, in such a way, that when the sphere (1) receives a strike, the spring of the frontal hinge (6) activates the movement of the central casing (9), moving it downwards, and the cylindrical arms (7) upon reaching medium height, push the caps of the sphere (1) outwards to create an such an opening in the sphere (1), such that the body-shaped part (10) projects out from the lower part of the sphere (1), and upon being ejected, the caps close automatically with a spring at the upper hinge (4).

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
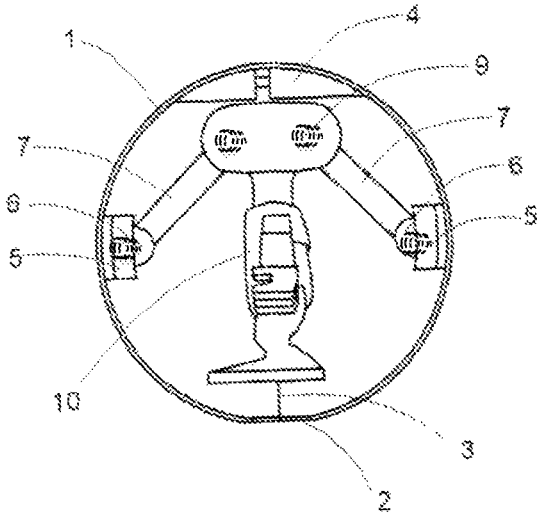
FIG. 1 shows a cross-section view of the toy in a compact position.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not limit the invention, except as outlined in the claims.

The present invention is a toy with an extendable mechanism, wherein the toy is capable of transforming its original compact shape into a new entity, without the need to manipulate its parts or add new parts.

As shown in FIGS. 1 to 10, the present invention is composed of a hollow sphere (1), provided with a circular opening in the lower part thereof (2) and a vertical cut (3) along a lateral diameter of the sphere (1), which divides the sphere (1) into two symmetrical caps of the sphere (1), and the spheres interior includes an upper hinge (4), composed of two protuberances attached to both caps and an internal central spring (not depicted), and from the front and rear parts two hollow convex protuberances (5) are projected, each with a circular swivel (6) inside, of which, the frontal swivel is surrounded by a spring, additionally, both swivels articulate two cylindrical arms (7) with an oblique ascendant inclination, the upper parts of the cylindrical arms (7) converging in two circular swivels (8)(e.g., see FIG. 4), provided with a radial sequence of curved concave notches, in turn, these circular swivels (8) are contained within a central casing (9) having a rectangular profile and round edges, and from the lower part thereof a body-shaped part (10) is projected, in this example provided with a neck, a central torso, two lateral arms with their respective hands and two lower legs with their respective feet, in such a way that, when the sphere (1) receives a strike, the spring of the frontal swivel (6) activates the movement of the central casing (9), moving it downwards, and the cylindrical arms (7) upon reaching medium height, push the caps of the sphere (1) outwards, creating an opening such that the body-shaped part (10) may be projected from the lower part of the sphere (1), and as soon as the body-shaped part (10) is out, the caps of the sphere (1) close automatically with the spring of the hinge (4), in such a way, that as soon as the body is out, the sphere (1) is constituted at the head of the body-shaped part (10), and together they constitute an entity different from the initial one.

In addition, the body-shaped part (10) displays a series of supplementary characteristics that confer a high number of supplementary features thereto, among which, emphasis is made on the feature of being formed by one single part, which provides it with a higher rigidity and resistance. The hands present a slot (11) that allows the inclusion of other elements, and the feet, in addition to presenting a flat base that grants it higher stability, show a central hexagonal sunken area (12), which allows stacking it to other elements.

The shape of the body-shaped part (10) can also allow for variations depending on the targeted segment, ranging from the body type, whether it is animal or human, the latter with male, female, or asexual gender, or with the appearance of a baby, child or adult. The sphere (1) can also allow for different variations, ranging from an oval shape, different colors or textures, or different faces, depending on the adhesive adjoined to the front surface.

Figure 2:
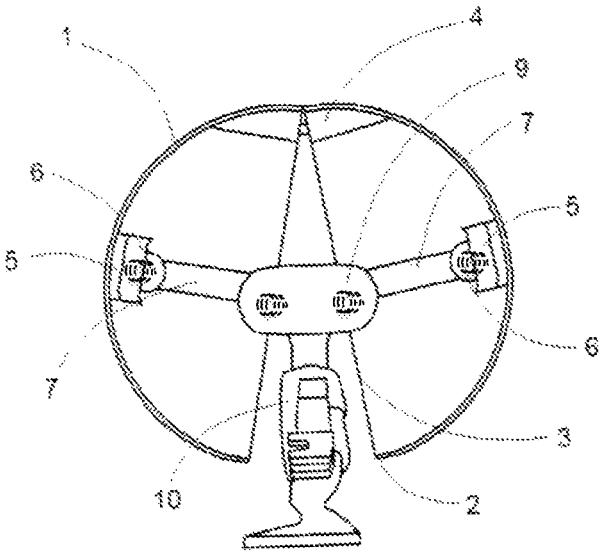
FIG. 2 shows a cross-section view of the toy in a semi-extended position.

FIG. 2 shows a cross-section view of the toy in a semi-extended position in which the body-shaped part (10) is completely outside of the hollow-sphere (1) the caps have closed back into the spherical shape.

Figure 3:
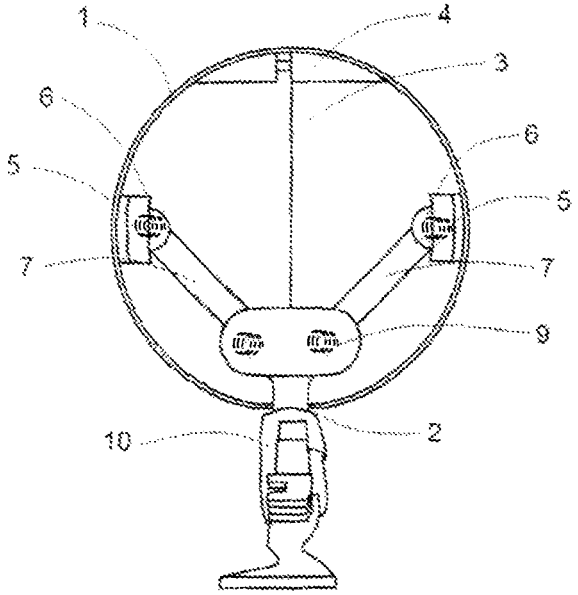
FIG. 3 shows a cross-section view of the toy in an extended position.

FIG. 3 shows a cross-section view of the toy in an extended position, in which the body-shaped part (10) is part of the way out of the hollow-sphere (1) and in which the body-shaped part (10) has passed across the location of the hinges have reached past the frontal swivel (6) such that the body-shaped part (10) will continue to extend.

Figure 4:
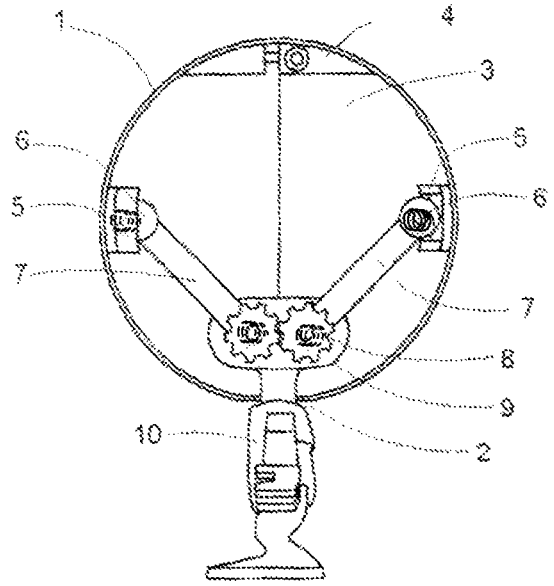
FIG. 4 shows a cross-section view of the toy in an extended position, showing the internal mechanism that moves the internal body.

FIG. 4 shows a cross-section view of the toy in an extended position, showing the internal mechanism that moves the body-shaped part (10), and in which the body-shaped part (10) is completely outside the hollow sphere (1) and the caps have closed. This figure also shows the additional detail for the mechanism of the circular swivels (8) inside the central casing (9).

Figure 5:
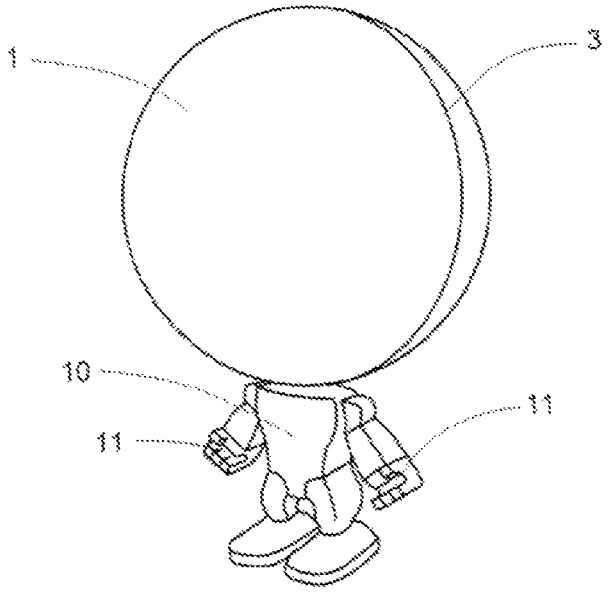
FIG. 5 shows a perspective view of the toy in an extended position.

FIG. 5 shows a perspective view of the toy in an extended position in which the body-shaped part (10) is completely outside the hollow sphere (1) and the caps have closed, with the further detail of slots (11) at the hands of the body-shaped part (10).

Figure 6:
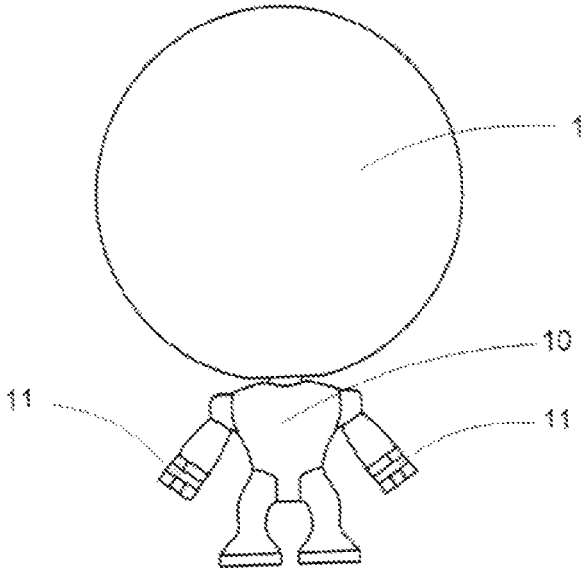
FIG. 6 shows a frontal elevation view of the toy in an extended position.

FIG. 6 shows a frontal elevation view of the toy in an extended position in which the body-shaped part (10) is completely outside the hollow sphere (1) and the caps have closed, with the further detail of slots (11) at the hands of the body-shaped part (10).

Figure 7:
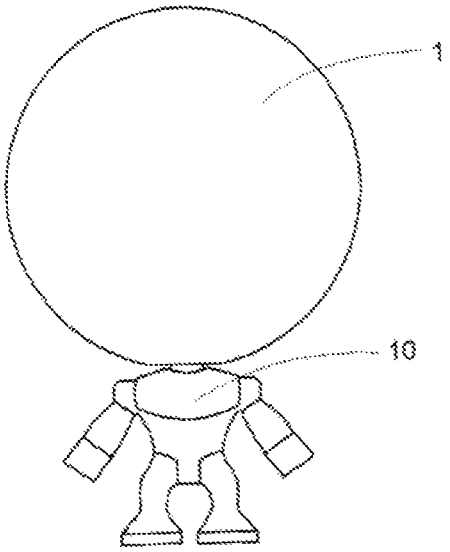
FIG. 7 shows a rear elevation view of the toy in an extended position.

FIG. 7 shows a rear elevation view of the toy in an extended position in which the body-shaped part (10) is completely outside the hollow sphere (1) and the caps have closed.

Figure 8:
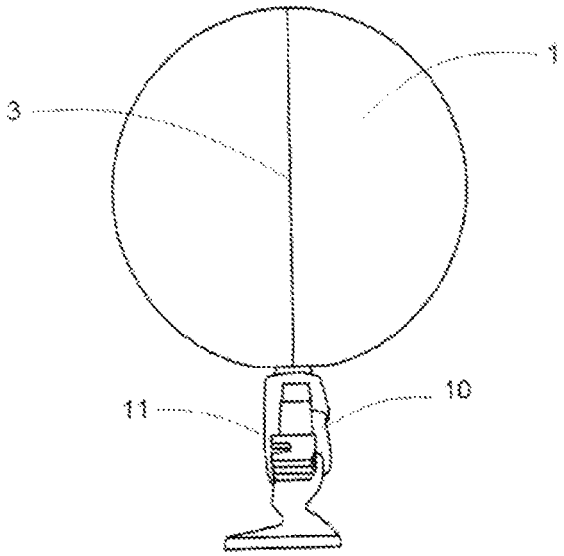
FIG. 8 shows a right profile view of the toy in an extended position.

FIG. 8 shows a right profile view of the toy in an extended position in which the body-shaped part (10) is completely outside the hollow sphere (1) and the caps have closed, with the further detail of slots (11) at the hands of the body-shaped part (10) and showing the longitudinal cuts that form the two caps of the hollow sphere (1).

Figure 9:
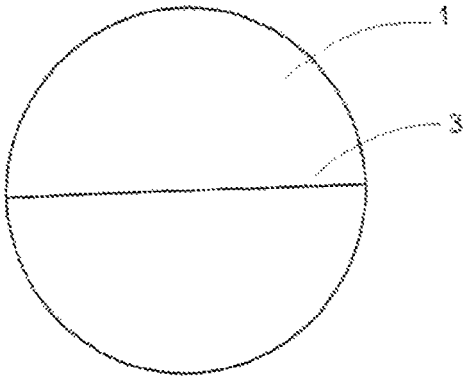
FIG. 9 shows an upper level view of the toy in an extended position.

FIG. 9 shows an upper level view of the toy showing the longitudinal cuts that form the two caps of the hollow sphere (1).

Figure 10:
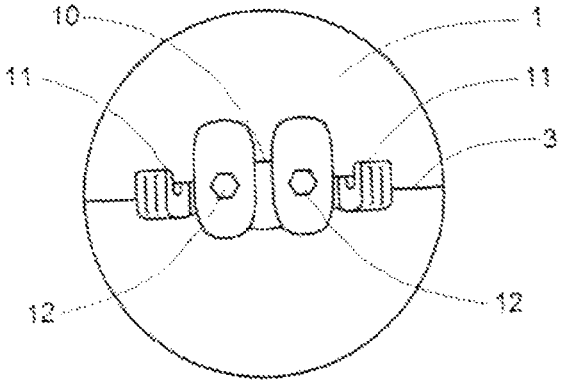
FIG. 10 shows a lower level view of the toy in an extended position.

FIG. 10 shows a lower level view of the toy in an extended position in which the body-shaped part (10) is completely outside the hollow sphere (1) and the caps have closed, with the further detail of slots (11) at the hands of the body-shaped part (10), and further show a central hexagonal sunken area (12) (but it can have any shape), which allows stacking it to other elements.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB.

Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112, U.S.C. § 112 paragraph (f), or equivalent, as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A toy comprising:

a hollow sphere (1) comprising two symmetrical caps, having a circular opening on a lower part thereof (2) and a vertical cut (3) on a lateral diameter, wherein the two symmetrical caps can be separated at the vertical cut;

an upper hinge (4) at a top of the hollow sphere (1) that connects the two symmetrical caps;

a first and a second protuberance (5) centrally located in each of the two symmetrical caps connected to a first and a second spring, respectively;

a first and a second circular hinge (6) located internally from the first and second protuberances (5), respectively, wherein each of the first and second hinges connects to the first and second springs, respectively, and each of the first and second hinges articulate a first and a second cylindrical arm (7), respectively, with oblique ascendant inclination, wherein each of the first and second cylindrical arms (7) connects to a first and a second central hinge (8) having a radial sequence of curved concave notches, wherein each of the first and second central hinges (8) are within a central casing (9); and a body-shaped part (10) connected to the central casing (9), wherein the body-shaped part (10) comprises: a neck, a central torso, one or more lateral arms with their respective hands, or one or more lower legs with their respective feet, wherein when the hollow sphere (1) receives a strike, the first and second springs of the first and second circular hinges are spring-loaded to (6) open the hollow sphere and eject the body-shaped part (10), and upon being ejected, an upper spring closes the symmetrical caps, wherein the body-shaped part (10) remains attached to the hollow sphere (1), and forms a head of the body-shaped part (10).

2. The toy of claim 1, wherein the body-shaped part is constituted by one single part.

3. The toy of claim 1, wherein the body-shaped part comprises hands and wherein the hands comprise a slot that allows each hand to grip other elements.

4. The toy of claim 1, wherein the body-shaped part comprises feet and wherein the feet are flat to provide the toy with vertical stability and wherein each of the feet further comprises a central sunken area (12) to stack elements.

5. The toy of claim 1, wherein the body-shaped part has the appearance of a human or animal that is male, female, asexual gender, a baby, a child, or an adult.

6. The toy claim 1, wherein the hollow sphere comprises an oval shape, different colors or textures, or different faces.

7. A toy consisting essentially of:

a hollow sphere (1) comprising two symmetrical caps, having a circular opening on a lower part thereof (2) and a vertical cut (3) on a lateral diameter, wherein the two symmetrical caps can be separated at the vertical cut;

an upper hinge (4) at a top of the hollow sphere (1) that connects the two symmetrical caps;

a first and a second protuberance (5) centrally located in each of the two symmetrical caps connected to a first and a second spring;

a first and a second circular hinge located internally from the first and second protuberances (5), respectively, wherein each of the first and second hinges connects to the first and second springs, respectively, and each of the first and second hinges are spring-loaded and articulate a first and a second cylindrical arm (7), respectively, with oblique ascendant inclination, wherein each of the first and second cylindrical arms (7) connects to a first and a second central hinge (8) having a radial sequence of curved concave notches, wherein each of the first and second central hinges (8) are within a central casing (9); and a body-shaped part (10) connected to the central casing (9), wherein the body-shaped part (10) comprises: a neck, a central torso, one or more lateral arms with their respective hands, or one or more lower legs with their respective feet, wherein when the hollow sphere (1) receives a strike, the first and second springs of the first and second circular hinges (6) are spring loaded to open the hollow sphere and eject the body-shaped part (10), and upon being ejected, an upper spring closes the symmetrical caps, wherein the body-shaped part (10) remains attached to the hollow sphere (1) and forms becomes a head for the body-shaped part (10).

8. A toy consisting of:

a hollow sphere (1) comprising two symmetrical caps, having a circular opening on a lower part thereof (2) and a vertical cut (3) on a lateral diameter, wherein the two symmetrical caps can be separated at the vertical cut;

an upper hinge (4) at a top of the hollow sphere (1) that connects the two symmetrical caps;

a first and a second protuberance (5) centrally located in each of the two symmetrical caps connected to a first and a second spring;

a first and a second circular hinge (6) located internally from the first and second protuberances (5), respectively, wherein each of the first and second hinges connects to the first and second springs, respectively, and each of the first and second hinges are spring-loaded and articulate a first and a second cylindrical arm (7), respectively, with oblique ascendant inclination, wherein each of the first and second cylindrical arms (7) connects to a first and a second central hinge (8) having a radial sequence of curved concave notches, wherein each of the first and second central hinges (8) are within a central casing (9); and a body-shaped part (10) connected to the central casing (9), wherein the body-shaped part (10) comprises: a neck, a central torso, one or more lateral arms with their respective hands, or one or more lower legs with their respective feet, wherein when the hollow sphere (1) receives a strike, the first and second springs of the first and second circular hinges (6) are spring loaded to open the hollow sphere and eject the body-shaped part (10), and upon being ejected, an upper swing closes the symmetrical caps, wherein the body-shaped part (10) remains attached to the hollow sphere (1) and forms a head for the body-shaped part (10).

* * * * *